US005360149A

United States Patent [19]

Lucot

[11] Patent Number: 5,360,149

[45] Date of Patent: Nov. 1, 1994

[54] CARRYING HARNESS FOR AN OPTICAL DEVICE

[76] Inventor: Jerome C. Lucot, P.O. Box 19, Brookville, Pa. 15825

[21] Appl. No.: 20,376

[22] Filed: Feb. 22, 1993

[51] Int. Cl.[5] ..... A45F 3/14

[52] U.S. Cl. ..... 224/257; 224/202; 224/269; 224/909

[58] Field of Search ..... 224/259, 257, 258, 908, 224/909, 202, 209, 224, 260, 268, 269; 354/81, 82

[56] References Cited

U.S. PATENT DOCUMENTS

| | | | |
|---|---|---|---|
| 3,326,430 | 6/1967 | Banks | 224/909 |
| 3,326,432 | 6/1967 | Banks et al. | 224/909 X |
| 3,526,347 | 9/1970 | Kuban | 224/909 X |
| 3,884,403 | 5/1975 | Brewer | 224/908 X |
| 4,349,139 | 9/1982 | Oishi | 224/909 X |
| 4,461,411 | 7/1984 | Harron | 224/258 X |
| 4,905,878 | 3/1990 | Lovinger et al. | 224/224 X |
| 5,016,797 | 5/1991 | Rowledge | 224/908 X |

FOREIGN PATENT DOCUMENTS 245405 4/1912 Germany .

*Primary Examiner*—Glenn J. Barrett
*Attorney, Agent, or Firm*—Richard L. Miller

[57] ABSTRACT

A carrying harness for an optical device is provided and consists of a strap loop worn about an upper torso of a person, while a pair of slide fasteners connect the optical device to a front portion of the strap loop. The slide fasteners will normally position the optical device against an abdominal area of the person, when in a carrying mode and selectively allows the optical device to be slid into an eye level position when in an operating mode.

3 Claims, 1 Drawing Sheet

CARRYING HARNESS FOR AN OPTICAL DEVICE

BACKGROUND OF THE INVENTION

The instant invention relates generally to article carriers and more specifically it relates to a carrying harness for an optical device.

Numerous article carriers have been provided in the prior art that are adapted to be worn on the front of the torso of a person to retain a camera, binoculars and similar articles to his/her person. For example, U.S. Pat. Nos. 3,326,430 to Banks; 4,461,411 to Harrow and 5,016,797 to Rowledge and German patent numbered 245,405 to Stein all are illustrative of such prior art. While these units may be suitable for the particular purpose to which they address, they would not be as suitable for the purpose of the present invention as hereafter described.

SUMMARY OF THE INVENTION

A primary object of the present invention is to provide a carrying harness for an optical device that will overcome the shortcomings of the prior art devices.

Another object is to provide a carrying harness for an optical device supported on a body of a person, so that the optical device is available for immediate use or operation by allowing it to be elevated quickly to the level of the eyes of the person.

An additional object is to provide a carrying harness for an optical device that will protect the optical device from accidental damage through striking or dropping the optical device.

A further object is to provide a carrying harness for an optical device that is simple and easy to use.

A still further object is to provide a carrying harness for an optical device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
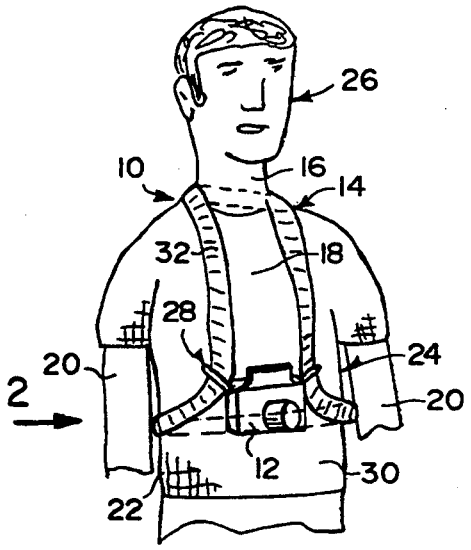
FIG. 1 is a diagrammatic front perspective view illustrating the instant invention being worn by an individual to secure an optical device to his/her person.
Figure 2:
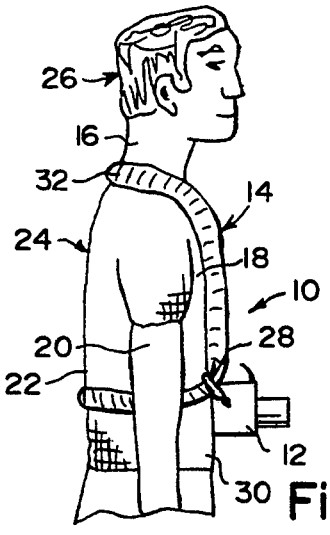
FIG. 2 is a diagrammatic side view thereof, taken in the direction of arrow 2 in FIG. 1.
Figure 3:
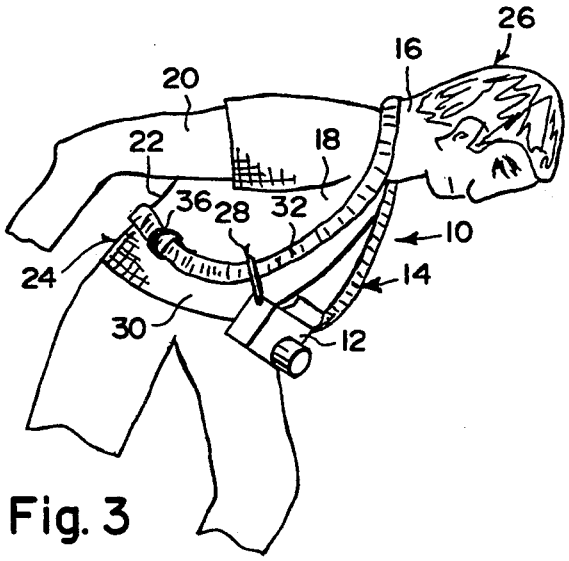
FIG. 3 is a diagrammatic perspective view illustrating a person bending over wearing the instant invention, demonstrating how the optical device is prevented from swinging free from his/her body.
Figure 4:
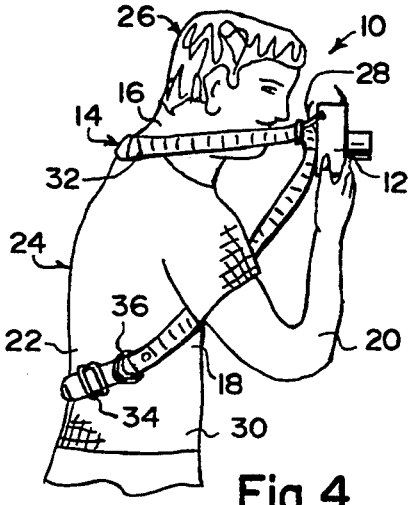
FIG. 4 is a diagrammatic view of a person utilizing the instant invention by sliding the optical device to the level of the eyes.

Turning now descriptively to the drawings, in which similar reference characters denote similar elements throughout the several views, FIGS. 1 through 4 illustrate a carrying harness 10 for an optical device 12 consisting of a single length of material formed into a strap loop 14 extending behind a neck 16, down a front of a chest 18, under a pair of arms 20 and about a small of a back 22 of an upper torso 24 of a person 26. A pair of slide fasteners 28 are for connecting the optical device 12 to the front portion of the strap loop 14, which will normally position the optical device 12 against an abdominal area 30 below the check 18 of the person 26, when in a carrying mode (FIGS. 1, 2 and 3) and selectively allows the optical device 12 to be slid into an eye level position when in an operating mode (FIG. 4).

Figure 5:
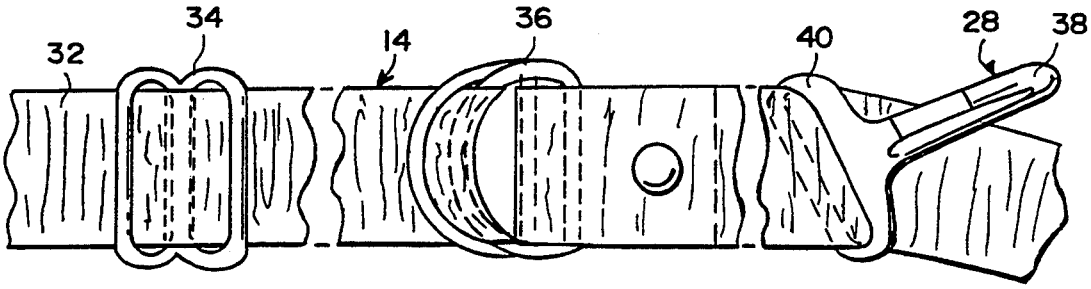
FIG. 5 is an enlarged elevational view with parts broken away illustrating the end keeper, D-ring and spring clip in greater detail on the length of material.

The strap loop 14 is a flexible non-elastic length of material 32, which is formed into an adjustable endless belt and includes, as best seen in FIG. 5, an end keeper 34 to fit upon the length of material 32 to engage with a loose end thereof. A pair of D-rings 36 fits upon the length of material 32 for securing ends thereof and adjusting the length of the strap loop 14, so that it will properly fit about the upper torso 24 of the person 26.

Each slide fastener 28 has a spring clip 38, having a slotted end 40 to slide along the length of material 32. The spring clip 38 can engage with a ring or aperture provided on the optical device 12, which can be a camera, binoculars or similar article.

To use the carrying harness 10, the person 26 simply passes the strap loop 14 behind the neck 16 and the small of the back 22 and places the arms 20 through, so that right and left portions of the strap loop 14 are in front of the chest 18. The optical device 12 is then secured by the slide fasteners 28 in front, in which the weight of the optical device 12 will normally position it against the abdominal area 30, even if the person 26 bends over, as shown in FIG. 3. When the person 26 wants to use the optical device 12, it is pulled upwardly to the eye level position, as shown in FIG. 4.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A carrying harness for an optical device consisting essentially of:

a) an endless strap loop consisting essentially of an elongated neck portion and an elongated lower back back portion extending directly across a back of a neck and a small of a back, respectively, and a pair of front portions extending in laterally spaced apart relation down a front of a chest, and under a pair of arms of an upper torso of a person so as to join respective ends of the neck portion to respective ends of the lower back portion, wherein said strap loop consists essentially of only a single, flexible non-elastic band of material joined only at opposite longitudinal ends thereof to form only a single closed loop; and b) a pair of slide fasteners each slidably connected to said strap and adapted for connecting said optical device to a front portion of said strap loop so that said front portion are linked together at a front of a person only be said optical device, and which will normally position said optical device against an abdominal area below the chest of the person when in a carrying mode and selectively allows said optical device to be slid into an eye level position when in an operating mode.

2. A carrying harness for an optical device as recited in claim 1, wherein said strap loop is adjustable in length and includes:

a) an end keeper to fit upon said length of material to engage with a loose end thereof; and b) a pair of D-ring to fit upon said length of material for securing opposite ends thereof and adjusting length of said strap loop, so that it will properly fit about said upper torso of said person.

3. A carrying harness for an optical device as recited in claim 2, wherein each said slide fastener has a spring clip for connecting to an optical device and a slotted end to slide along said length of material.

* * * * *